US005407082A

United States Patent [19]

Childress et al.

[11] Patent Number: 5,407,082

[45] Date of Patent: Apr. 18, 1995

[54] AUTOMATIC EJECTOR RATE NORMALIZER USING MULTIPLE TRIP LEVELS ESTABLISHED IN A MASTER CHANNEL

[75] Inventors: Joel P. Childress, Sugarland; Edward G. Reyes; Calvin G. Gray, both of Houston, all of Tex.

[73] Assignee: ESM International Inc., Houston, Tex.

[21] Appl. No.: 282,205

[22] Filed: Jul. 28, 1994

[51] Int. Cl.[6] ..... B07C 5/342

[52] U.S. Cl. ..... 209/582; 209/587; 356/425

[58] Field of Search ..... 209/576–582, 209/587, 908; 356/407, 408, 420, 421, 425; 364/478, 526

[56] References Cited

U.S. PATENT DOCUMENTS 4,235,342 11/1980 Braham .
4,454,029 6/1984 Codding ..... 209/581
4,513,868 4/1985 Culling et al. .
4,626,677 12/1986 Browne .
4,699,273 10/1987 Suggi-Liverani et al. .
4,774,718 9/1988 Zivley et al. .
4,807,762 2/1989 Illy et al. .
4,878,582 11/1989 Codding ..... 209/582 X
5,278,768 1/1994 Brum ..... 209/582 X
5,353,937 10/1994 Childress ..... 209/587 X

*Primary Examiner*—D. Glenn Dayoan
*Attorney, Agent, or Firm*—Vaden, Eickenroht, Thompson, Boulware & Feather

[57] ABSTRACT

In a bichromatic sorting machine, a polygon pattern of trip level boundaries is established for a master channel programmable memory that is representative of orthogonally plotting detected products in each of two reflectivity spectral bands. The rate of products passing through the master channel that is rejected as being non-acceptable by producing a reflectivity value outside of the polygon pattern compared to total products sorted is used as the basis for normalizing all channel results. When the actual rate in the master channel varies from the desired rate, the boundaries of its polygon are concentrically adjusted back to the desired rate, thereby also adjusting the similar polygon patterns for each of the other or slave channels. Multiple machines can also be normalized to the same rate in similar fashion. The master channel or the master machine can be selectable, a concept that is also applicable to monochromatic sorting machines, as well.

14 Claims, 5 Drawing Sheets

AUTOMATIC EJECTOR RATE NORMALIZER USING MULTIPLE TRIP LEVELS ESTABLISHED IN A MASTER CHANNEL

BACKGROUND OF THE INVENTION

1. Field of the Invention

This invention pertains to normalizing the ejection rate of fungible products progressing through multiple channels of a color sorting machine, or even through multiple channels of multiple machines, to a common master channel by the use of trip level adjustments.

2. Description of Prior Art

A typical sorting machine used for sorting fungible products, such as for sorting acceptable quality food products from non-acceptable quality food products, generally comprises for each channel through which the products to be sorted pass, one or more lighting illumination sources; optical viewing and detection stations including suitable detectors and discrimination electronics; various electronic circuits for amplifying, conditioning and classifying signals into acceptable and unacceptable occurrences; and ejector mechanisms for removing the unacceptable products from the acceptable products, which may move through the machine by gravity feed or by being belt or conveyor fed. A machine typically includes multiple parallel channels of products moving at the same speed. Moreover, multiple machines are often employed in parallel sorting, each with multiple channels.

In any sorting machine that is comprised of more than one photo detector, typically, photosensitive silicon or germanium or other element pickup devices, there is an inherent problem in using a common control, conveniently referred to as a "trip level" in defining a point at which all offending material (i.e., non-acceptable products) should be ejected. Regardless of the effort expended in fabricating, assembling, testing, and "tweaking" of signals to seek conformity from one pickup device, or one view, to another, actual signals that should be the same coming off the devices will likely all be different after a short period of time. This is because of such factors as light bulb aging, dust accumulation, mechanical vibrations and variations in the surface treatment of channels, to name a few of the causes.

Many approaches have been used to minimize the problems discussed above. Compensating circuits, such as the patented auto-null system described in U.S. Pat. No. 4,626,677, "Continuous Normalizer for an Electronic Circuit that Compensates for External and Internal Drift Factors", Edward M. Browne, issued Dec. 2, 1986, helps insure that a signal, once amplified to a particular level, is constantly corrected. This technique does assist in removing the ill effects of electronic "drift" and dust accumulation. Mechanical and pneumatic cleaning systems also are useful in keeping the equipment relatively free of dust from the environment and products being sorted, at least for short periods of use. None of these approaches, however, completely remove the problems associated with the primary signals from various pickup devices being different in relative amplitude and direction after a period of equipment operation. So long as different signal generating devices are employed, there will exist a problem of conforming the signals.

One of the most successful approaches in ensuring that the above described variables are reduced, if not eliminated, is the approach disclosed in U.S. Pat. No. 4,774,718, "Automatic Ejector Rate Normalizer" George A. Zivley, et al., issued Sep. 27, 1988, commonly assigned, which is incorporated herein for all purposes. In a monochromatic sorting machine, this patent discloses the use of a trip level value that is a result of the rate of rejection in a master channel. The master channel rejection rate is compared to a standard value and when there is a deviation, a so-called distributed trip level is adjusted. This same procedure is followed for each of the other or slave channels, but the comparison is made not to its own independent trip level value, but to an adjusted trip level value that is the distributed trip level value times a multiplier. The multiplying factor is produced as controlled by an up/down counter, in turn controlled up or down by whether the slave channel counter output or the master channel counter output arrives first. The multiplier makes the adjusted trip level value higher or lower to change the sensitivity of the slave channel to keep it operating at the same rate as the operation of the master channel.

Although the above scheme is readily suited for monochromatic sorting using analog components, the scheme is not practical for bichromatic sorting machines, for the flexible selection of which channel is designated as "master" or to the interconnecting of multiple sorting machines for operating at a uniform rate of rejection.

Therefore, it is a feature of the present invention to provide an improved automatic ejector rate normalizer for monochromatic sorting machines, and to extend the concept for bichromatic sorting machines having multiple channels and for multiple sorting machines operating at the same time to the same rate of rejection.

It is another feature of the present invention to provide improved automatic rejector rate normalizing for multiple channel bichromatic sorting machines and such multiple machines, wherein sorting can be readily normalized to the rate of any channel as the master.

It is still another feature of the present invention to provide improved automatic ejector rate normalizing with respect to adjustable trip levels of a selectable one of multiple channels of a bichromatic sorting machine or of ganged sorting machines.

SUMMARY OF THE INVENTION

A preferred embodiment of the present invention is implemented in a bichromatic sorting machine having multiple operating channels sorting fungible products at the same time so that the rate of rejection of each channel is the same by being normalized to one of the channels designated as the master channel. The fungible products are rejected on the basis of whether the light reflecting from the products as they pass through an optical viewing window are within an acceptable pattern of an orthogonal display, the light spectrum in a first frequency band being plotted with respect to one orthogonal axis and the light spectrum in a second frequency band being plotted with respect to the other orthogonal axis. The pattern can be determined from actual experience of sorting a large number of the fungible products and approximating the results of plotting the "acceptable" products with multiple straight "trip lines" usually four, to form a polygon. The trip lines can also be developed from trial and error, previous experience and the like. In any event, the set up values of the trip lines are stored in a programmable memory for the master channel and a similar memory for each of the other, or slave, channels. The rate of rejection, once determined as satisfactory, is maintained by concentrically adjusting the trip level values of the polygon in or out by comparing the actual rejected number of products in the master channel with a desired rate. The adjusting of the polygon in the master channel memory by a suitable normalizer adjusting means also adjusts the polygon in each of the slave channel memories to maintain a uniform rate rejection from channel to channel.

A flow rate measuring means can be used to ensure that the same or known proportional rate of total products are metered with respect to each channel. Alternatively, the total amount of products flowing in each slave channel is measured and compared to the measured master channel flow rate, a deviation therefrom resulting in a multiplier output to the respective slave channel programmable memories to concentrically adjust the respective polygons to maintain uniform rate rejection.

A ganged complex of sorting machines, each separately normalized as above, can also be normalized with respect to a selected supervisory machine by normalizing the master channel of each non-supervisory machine to the master channel of the supervisory machine.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope as the invention may admit to other equally effective embodiments.

In the Drawings.

DESCRIPTION OF THE PREFERRED EMBODIMENTS

Figure 1:
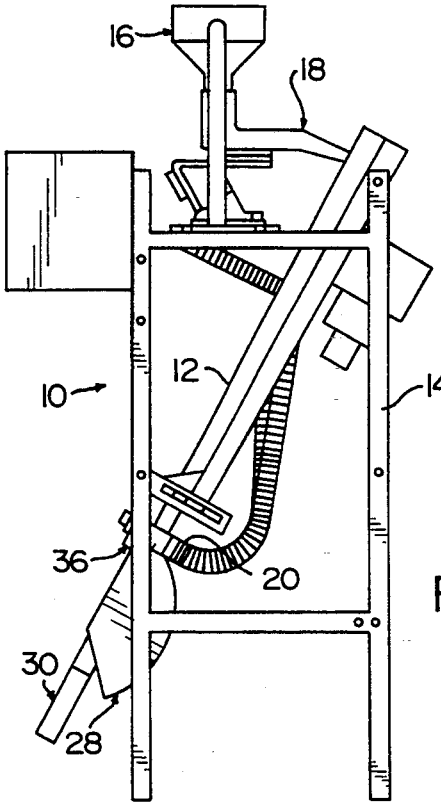
FIG. 1 is a side view of one channel of a simplified sorting machine in accordance with which the normalizing scheme invention herein described can be employed.

Now referring to the drawings, and first to FIG. 1, a high speed sorter for separating non-acceptable fungible products or items from a passing stream or flow of such products is shown. Generally, machine 10 includes one or more channels or chutes or slides 12 at a steep angle, usually over 45° and preferably nearly vertical on the order of 80°. The channels are held in position by a framework 14 and are gravity fed the products to be sorted from a hopper 16 at the top of the same framework. The products feed from hopper 16 through dividing vibratory feeder 18 to channels 12. Although a commercial machine of the type hereinafter discussed includes multiple channels 12 operating simultaneously with respect to the products that flow respectively through them, for simplicity of discussing FIG. 1, machine 10 is shown with only a single channel 12.

The products to be separated or sorted by machine 10 are small fungible items, such as coffee beans. Coffee beans, it will be appreciated, are individually identifiable by color in a bichromatic sorting machine in two spectral bands in a manner explained more fully hereinafter. The feed from the hopper via the vibratory feeder and down the channel is all by gravity action. The flow of the products is only slowed from free fall by the friction caused by the bends and the surfaces of the path. The products do move, however, at a fast rate in large quantity, as is well known in the art.

An optical viewer including appropriate photodetectors or a photosensor 20, is located toward the bottom part of the channel. As the flow of products passes past the viewer, any nonstandard or substandard products are sensed or detected as being non-acceptable for sorting purposes. It will be appreciated that such sensing or detection requires the non-acceptable products to be distinguished both from the standard or acceptable products and the background. Typically, a substandard item, such as a coffee bean, is detectable on the basis of its being darker or lighter or of a different color or hue from an acceptable range of darkness, lightness or color predetermined for standard or acceptable items in a manner explained below as determined for two spectral ranges. Thus, two sensors are required at each optical viewer, one for each of the bichromatic ranges. Typically, the products are viewed from multiple angles in each range, so sensing in each spectral range is really the result of pairs of two spectral ranges from the same viewing angle, any viewing pair being able to cause a rejection of a non-acceptable product. It is understood that a "spectral range" can be wholly or partially in the visual spectrum or can be wholly or partially in the nonvisual spectrum. For example, sensing in the infrared range is commonly done. When a substandard product or item is sensed, an electrical signal is produced that results in an ejection of the non-acceptable product by the actuation of an ejector mechanism.

An ejector 36 located underneath and adjacent optical sensor means 20 is actuated by the actuation electrical signal just mentioned to produce an air blast to remove the unwanted substandard product from the flow of products in the product stream. The ejector can be a mechanical ejector, if desired. When the actuation signal occurs, typically, a solenoid valve is operated to release or emit an air blast at the product stream to timely remove the substandard item. The delay in actuation is very short following the time of sensing, the timing being such to produce the desired expelling of the detected substandard item and is accomplished in a manner well known in the art. The items thus removed in the process fall down into reject accumulator 28 for subsequent disposal. The items not removed continue down channel extension 30 to be gathered or packaged as quality products passing the preset standards and avoiding removal. The control of the flow and the sensitivity of the sensors are controlled by controls including an automatic ejector rate normalizer as hereinafter described.

Each optical viewer generally includes a sensor suitable for detecting in a first spectral band and for producing a first signal that is representative of the reflectivity amount from a light source in the viewer in the first wavelength or spectral band for each of the products in the product stream passing through the viewer. Depending on the products sorted, it is well known that there are several spectral bands that are more significant for sorting of non-acceptable products from acceptable products. Thus, the first spectral band is selected from the most convenient bands based on experience with the products undergoing sorting. In like fashion, a sensor suitable for detecting in a second convenient selectable band produces a second signal that is representative of the reflectivity amount from a light source in the viewer in the second wavelength or spectral band for each of the products in the product stream passing through the viewer.

Figure 2:
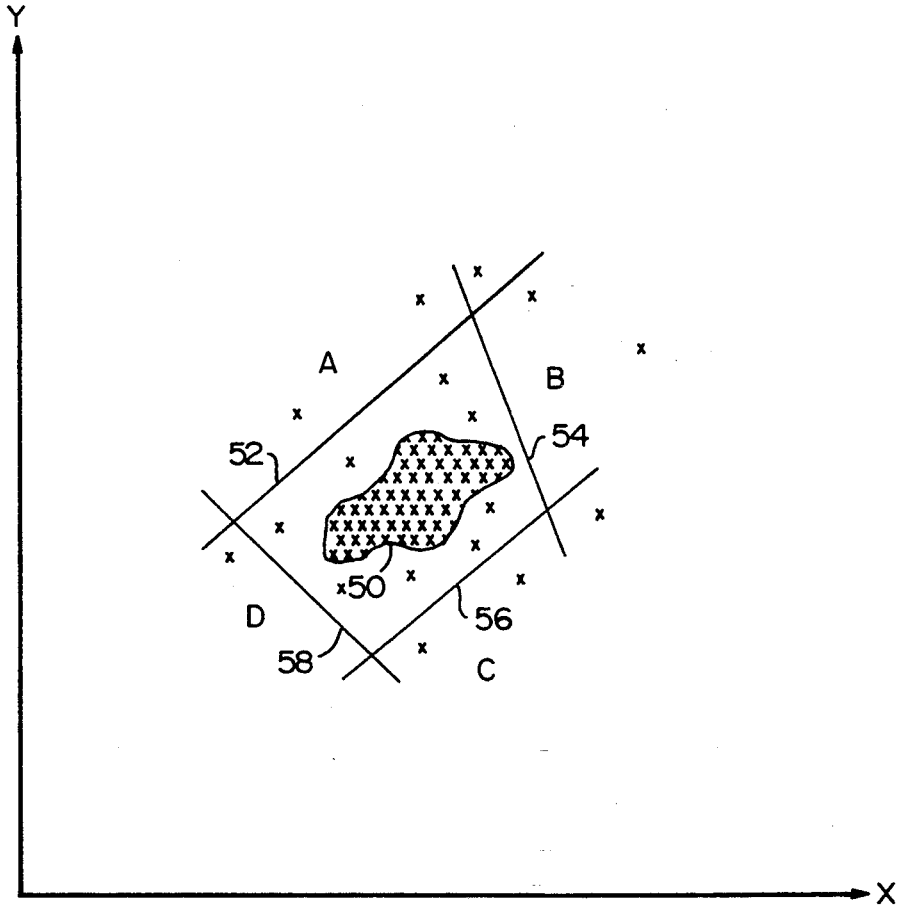
FIG. 2 is a polygon pattern of trip boundary lines employed in each of the memory segments of the programmable memories described for the present invention.

A large quantity of products passing through the optical viewer of a channel of a sorting machine can result in an orthogonal plotting to develop an overall pattern similar to that shown in FIG. 2, wherein each "x" represents the reflection off one product. The value of the first wavelength band for each product is plotted with respect to the "X" or horizontal axis and the value of the second wavelength band for each product is plotted with respect to the "Y" or vertical axis. Actually, many more "x's" would be plotted than the relatively few shown in FIG. 2 for convenience. The numbers could well run into the thousands to obtain a fair representation. In any event, once the "x's" are plotted, a pattern 50 can be identified to circumscribe the vast majority of closely positioned or overlapping "x's".

A polygon of straight trip lines 52, 54, 56 and 58 can then be drawn to fairly define an area within the polygon for "acceptable" products. Areas A, B, C and D identify areas where reflectivity of a product in the two bichromatic classifying bands would be outside of the polygon. At the corners of the polygon a product may be outside of the polygon by being on the reject side of more than one trip line. Any product having a reflectivity that is outside of the polygon is classified as a "non-acceptable"product.

It will be apparent that moving any one trip line will enlarge or reduce the area of the polygon and therefore cause a different percentage of products to be classified as "non-acceptable" than the polygon as shown. Although a single line could be moved without moving the other trip lines, it is also apparent that this would skew the rejected products to be more or less with respect to one of the areas A, B, C and D compared with the original polygon. Therefore, to make the percentage greater or lesser without skewing, concentric movement of all trip lines would be required.

Also, note that four trip lines have been chosen. In any actual polygon development, any convenient number of three or more trip lines can be employed.

The set up of the polygon shown in FIG. 2 has been explained with respect to a trial run of products presumed to be representative of a mass of products randomly selected as representative of the products to be sorted. In actual practice, such patterns can be predeveloped from previous experience or, alternatively, a polygon can be assumed within the orthogonal axis to be refined later by movement in accordance with the description set forth below. In any event, it is assumed that the polygon of trip lines can be used for sorting after once being stored in a programmable memory for suitable manipulation.

Figure 3:
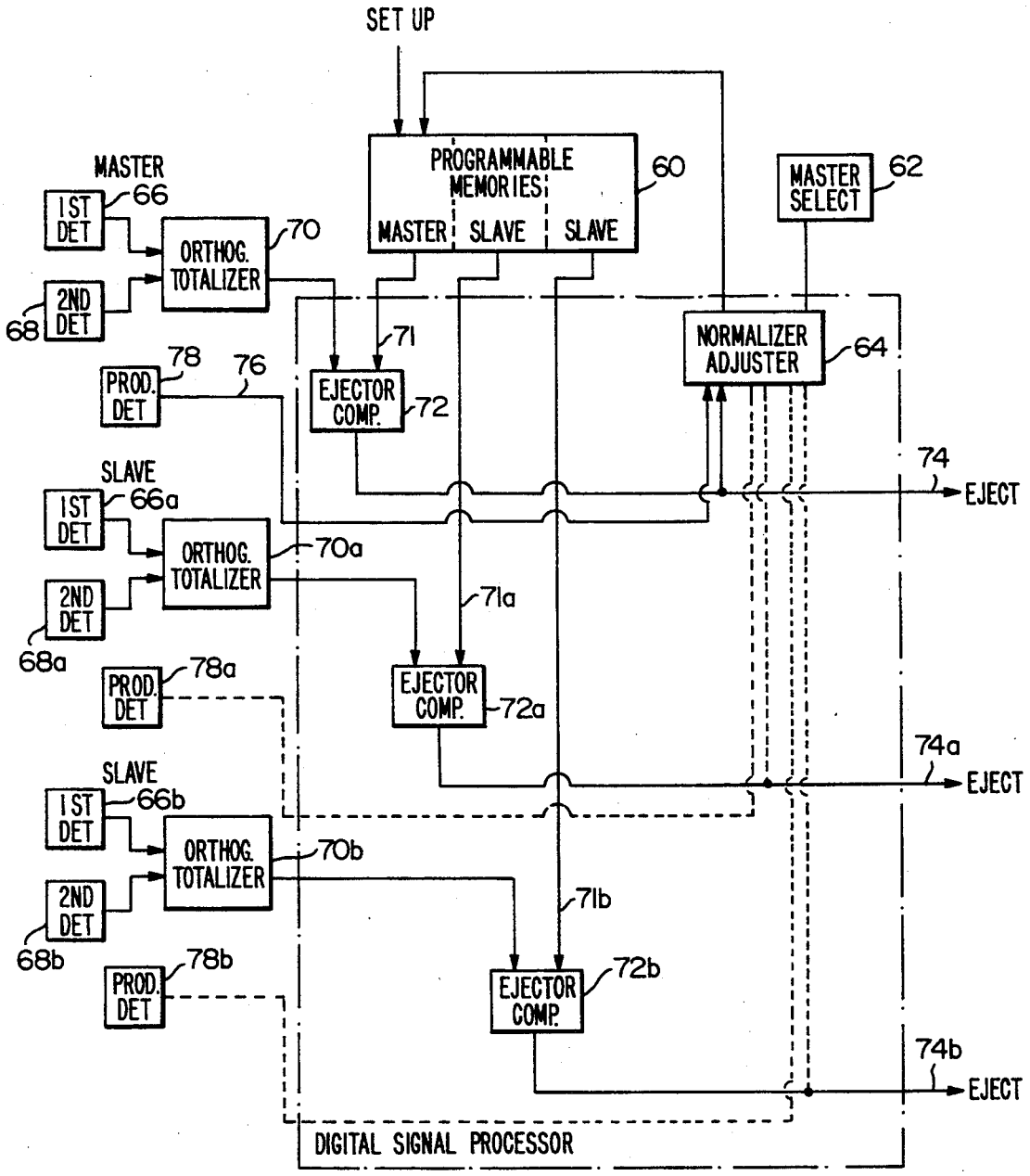
FIG. 3 is a block diagram of a preferred embodiment of the electronic normalizer circuit of the present invention.

Now referring to FIG. 3, the electronic processing portion of an electronic bichromatic sorting machine in accordance with an embodiment of the invention is shown in block diagram form. The machine is simplified in that only three channels are shown. An actual machine would normally have many more channels, each additional channel in an actual machine being an additional slave channel. Programmable memories include a memory or memory segment for the master channel and for each of the slave channels, each memory having stored therein a polygon of trip lines in accordance with the above discussion. A master select 62 output to normalizer adjuster 64 determines the percentage of non-acceptable products that will be ejected compared with the total products passing through the master channel, the input to the master segment of the programmable memories concentrically moving the trip lines in the memory to accomplish that result. Operation of the machine normally allows the operator to manually adjust the output of master select 62 and also to manually select which of the channels will be the master channel, the remaining channels being the slave channels.

In operation, first optical detector 66 and second optical detector 68 of the master channel determine for each product the orthogonal light reflectivity values in each of two spectral bands, as previously discussed, in orthogonal totalizer 70. The single output from totalizer 70 is compared with a read input 71 from the master segment of memories 60 to determine if the product value is inside or outside of the master polygon of trip lines. If the product is outside of the pattern of the master channel, then a master channel eject signal 74 is produced to remove the detected "non-acceptable" product from the product stream in the manner described above.

Each product that moves past the optical viewer of the master channel is detected and a master channel total output 76 is produced from product detect circuit 78. The product detect circuit can include one of the detector photosensitive devices used in the first or second detector circuit or a separate sensor, as desired, as is well-known in the art. Each product produces a detected output that is supplied with the rejected output to normalizer adjuster 64. If the percentage of rejected products as represented by the number of signals 74 with respect to the total products detected, as represented by signal 76, i.e., the rate, is different from the master select rate from master select circuit 62, the output from normalizer adjuster 64 concentrically adjusts the trip line boundaries of the master segment polygon in memories 60 to bring the rate toward the desired value.

In similar fashion, detectors **66*a* and 68*a* produce an orthogonal signal for each product detected from orthogonal totalizer 70*a*. Totalizer output is compared with a read output 71*a* from the first slave segment of programmable memories 60, which produces a reject output 74***a* from comparator 72*a* when the compared signal shows the detected product that produces a reflectivity signal outside of the polygon pattern of trip lines in the first slave segment of memories 60. The rate of rejection is changed over a period of time to conform to the master channel since the output from normalizer adjuster 64 not only changes the master channel memory polygon, but each of the slave channel memory polygons in similar fashion. The absolute number of rejects in a time segment for each slave channel will be forced to be approximately the same as the master channel, but this does not insure that the ratio of rejects to total product flow will be the same. This is due to the fact that the system cannot, by itself, force the flow through each channel to be equal.

Operation of the second slave channel is operationally the same as for the first slave channel, the components being designated using a "b" series of numbers for convenience, but the parts themselves being operationally the same as those described for the first or "a" slave channel.

It may be noted that each of the slave channels includes a product detect circuit 78*a*, 78*b* . . . 78*n*, that is used for determining the adjustment of the normalizer adjuster when the respective slave channels are selected for master channel operation in the manner previously described for the master channel. Otherwise, these product detector outputs are not used since the rate of rejection is independent of the absolute number of products flowing in a slave channel. For convenience, the product detectors can be used to meter a desired quantity of products to flow from a common source of products down each channel, however, in a matter well-known in the art.

It should be noted that all of the digital signal processing circuits can be included in a common circuit board, module or the like, if desired.

Figure 4:
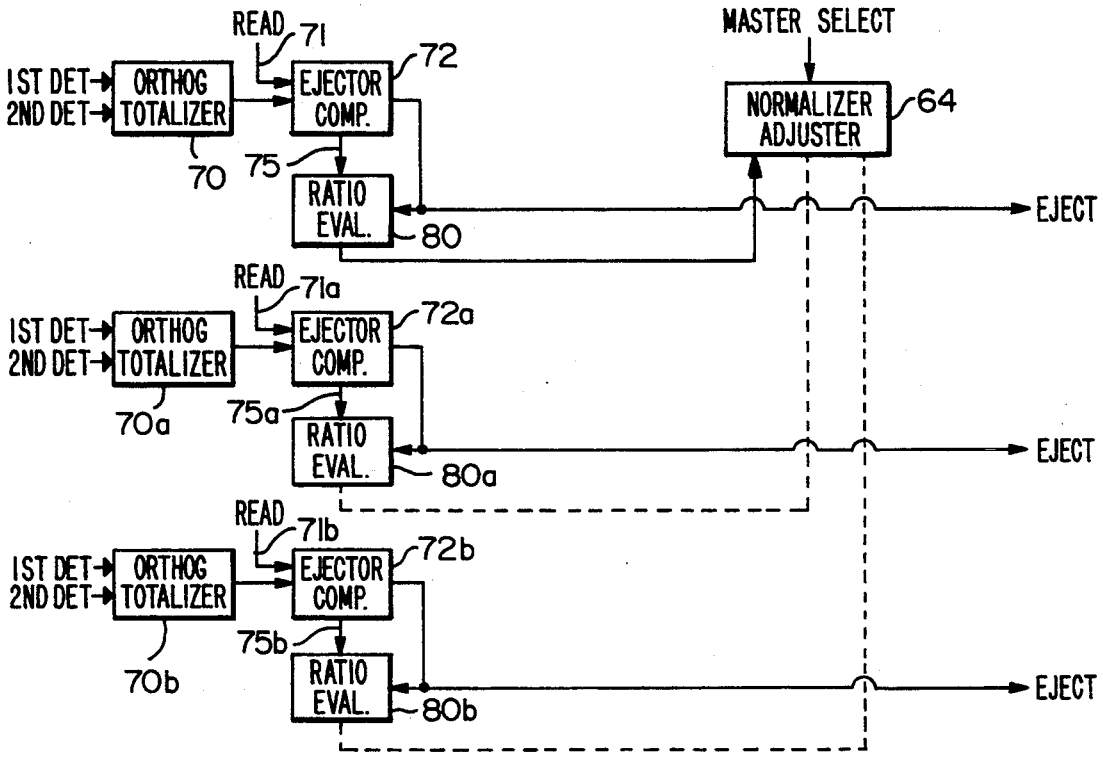
FIG. 4 is a partial block diagram of another preferred embodiment of the electronic normalizer circuit of the present invention.

Now referring to FIG. 4, an alternate operation is shown. Similar circuit components are identified with the same corresponding numbers as employed for such components in FIG. 3. Some of the components are not shown where their functional operations are the same, for convenience. In this embodiment, the output from ejector comparator is not used as an input for normalizer adjuster, although it is the ejector signal employed by the sorting machine for ejecting non-acceptable products from the master channel. Instead, the ejector comparator produces two outputs, one being "bad" output 74 for non-acceptable products, and the other being "good" output 75 for each acceptable product. Since the total of "good" and "bad" products is the total of the products in the product stream, a ratio evaluator 80 receiving both signal 74 and signal 75 computes a ratio output for driving normalizer adjuster 64 into conformity with a master select ratio number.

Each of the slave channels can include a ratio evaluator 80*a*, 80*b* . . . 80*n* so that each channel can be selected as the master channel, at the election of the operator. Otherwise, the operation of the slave channels is the same as for the operation of the master channel.

Figure 5:
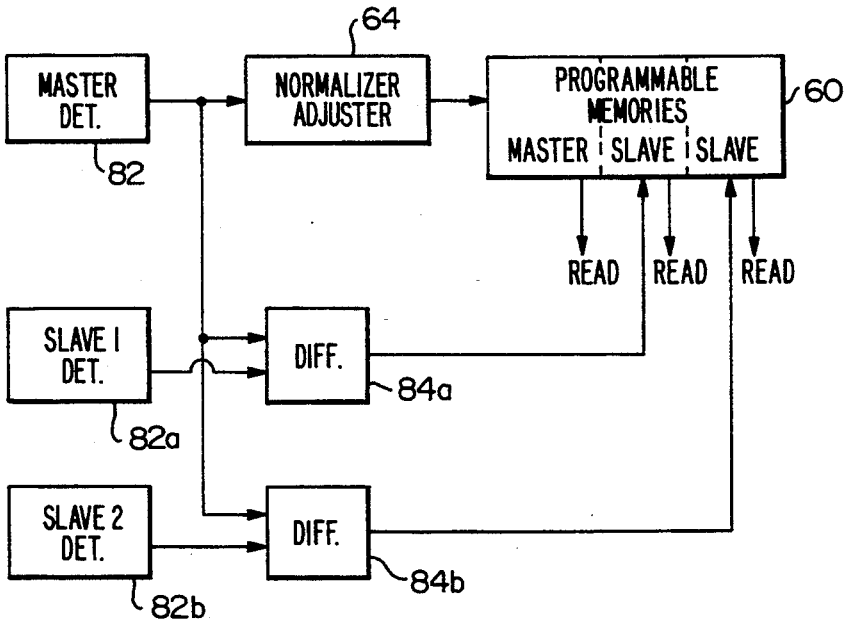
FIG. 5 is a partial block diagram of still another preferred embodiment of the electronic normalizer circuit of the present invention.

As noted, for each of the embodiments shown in FIGS. 3 and 4, normalizer adjuster 64 changes the polygon pattern of the master segment of programmable memories 60 and the polygon pattern of each of the slave channels at the same time. Turning to the FIG. 5 embodiment, it is assumed that the memory segments for the respective channels are not all affected by an output from normalizer adjuster 64, only the master channel memory segment. A master channel circuit component, such as ejector output 74 in FIG. 1 or the output from master ratio evaluator 80 in FIG. 2, is shown in FIG. 5 as a generic master detector 82 for changing normalizer adjuster 64, as previously described, which, in turn, reprograms the master segment of memories 60 by concentrically adjusting the polygon trip boundaries, as previously discussed.

In addition, similar outputs from slave 1 detector 82*a* for the first slave channel and from slave 2 detector 82*b* for the second slave channel are applied to respective differential circuits 84*a* and 84*b* with the output from master detector 82. The respective differential outputs are connected as the respective inputs to the slave segments of memories 60 for adjusting the polygons in the respective correct directions to reduce the differential outputs to zero and thus maintain the effective eject ratios of the respective channels at the same desirable value.

Figure 6:
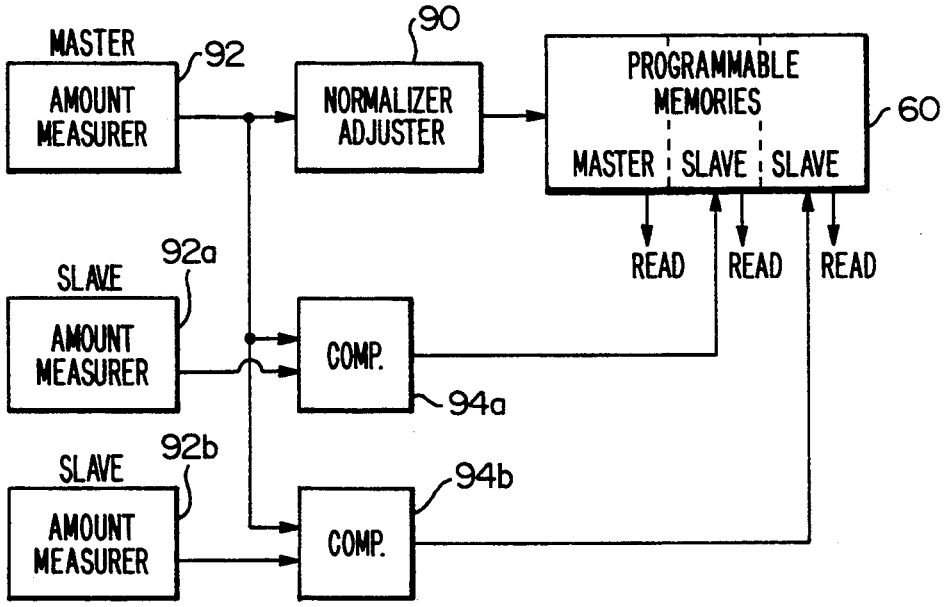
FIG. 6 is a partial block diagram of a total amount adjustment circuit employable with the normalizer circuit of the present invention.

It has previously been mentioned that metering means can be provided that the same total number of products are established for each channel in the embodiments just described. However, more often than not, this is not the case. Each channel product flow will be a little different from each of the others, in which case there can be a multiplier factor developed for each slave channel with respect to the master channel. This may be accomplished in one of the manners illustrated in FIGS. 6 and 7. Turning first to FIG. 6, it is assumed again for operational purposes that all of the memory segments of programmable memories 60 are simultaneously corrected or adjusted as needed by a master channel eject output (FIG. 3) or master channel ratio evaluator (FIG. 4). In addition, another output from a normalizer adjuster 90 can be developed from a total amount measurer circuit 92 in the master channel. The amount measurer can be the result of independently counting the products in the master channel with a different or existing detector, as has been discussed, or by developing a mass measurement of product area to total contrasting viewing window area over a period of time. In any event, the changes with respect to an initial value are applied to vary the master channel polygon, as has been described.

Similar amount measurer 92*a* for the first slave channel is applied to a comparator 94*a* with the output of amount measurer 92 from the master channel to produce an output for adjusting the polygon pattern of the first slave segment of memories 60. By varying the trip line boundaries of the polygon, the pattern read for ejection comparison purposes is modified to maintain a rate of rejection that takes into account variations in total channel flow, which can vary greatly over a period of time. The second slave channel is similarly controlled by amount measurer 92*b* and comparator 94*b*.

Figure 7:
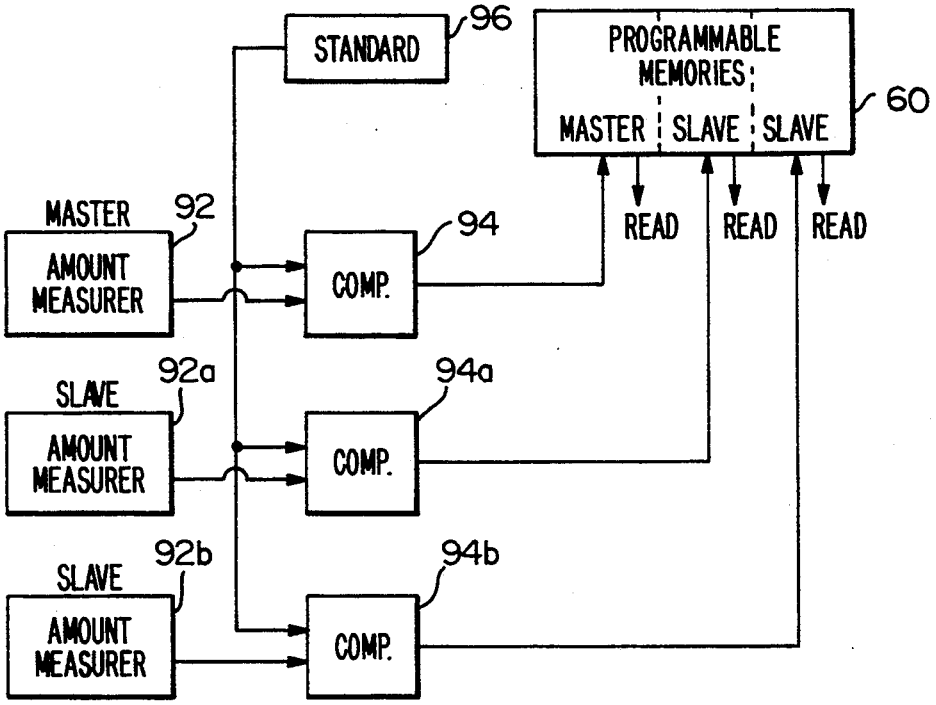
FIG. 7 is a partial block diagram of another total amount adjustment circuit employable with the normalizer circuit of the present invention.

If preferred, amount measurer 92, 92*a*, 92*b* . . . 92*n* and comparators, 94, 94*a*, 94*b* . . . 94*n* can be provided for all channels, as shown in FIG. 7, to have a common comparison output from a standard 96. Thus, no normalizer adjuster input is required for the master channel polygon pattern. Instead, the master channel polygon pattern is adjusted for total amount of product in the same manner as for the slave channel polygon pattern adjustments as were described for the FIG. 6 slave channels. Of course, the ejector rate adjustment would require a normalizer adjuster output, as previously described.

Figure 8:
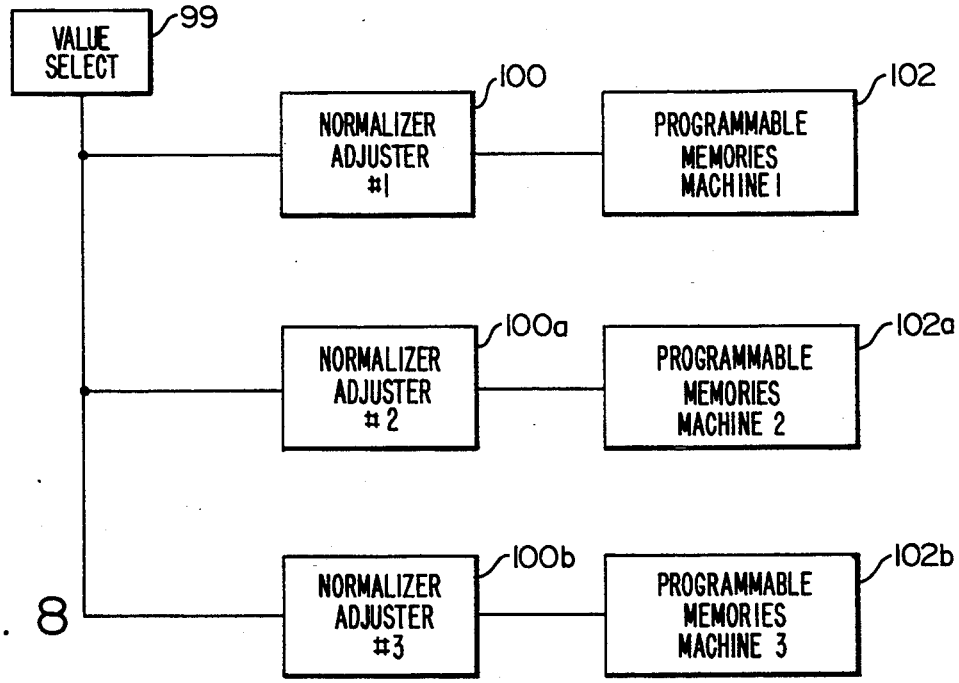
FIG. 8 is a partial block diagram of a scheme for normalizing a plurality of sorting machines in accordance with the present invention.
Figure 9:
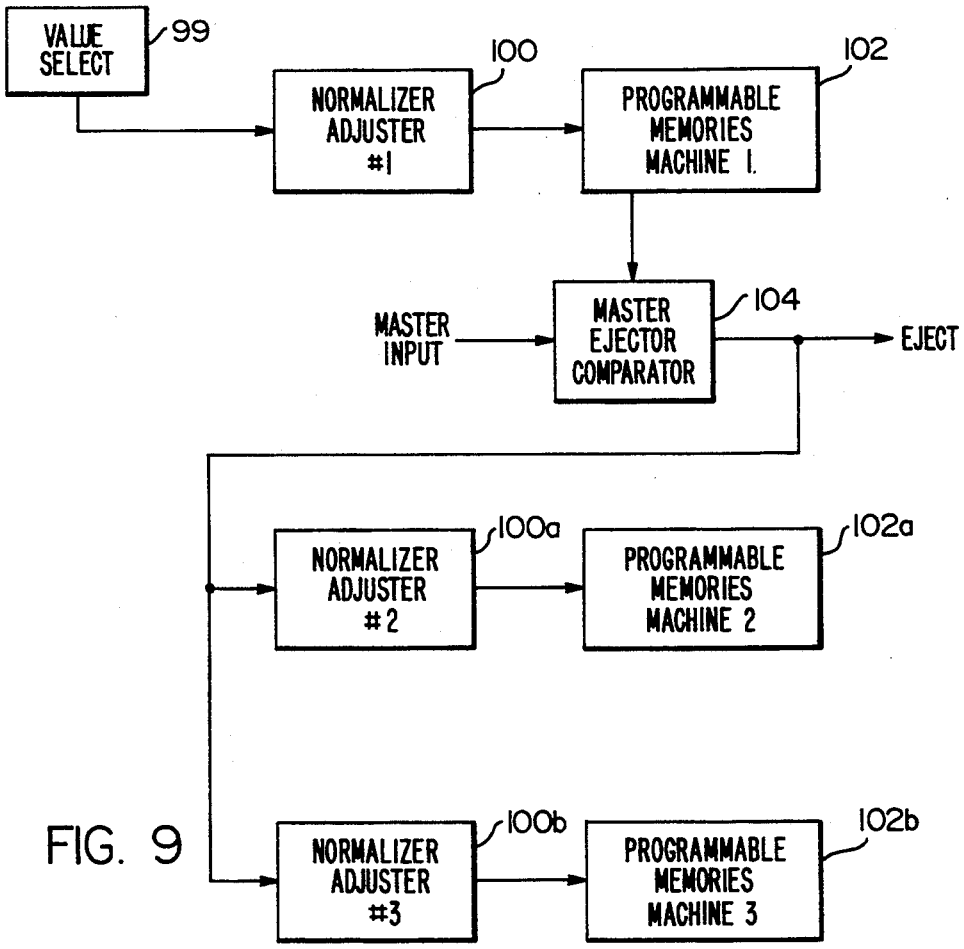
FIG. 9 is a partial block diagram of an alternate scheme for normalizing a plurality of sorting machines in accordance with the present invention.

More than one machine of the type that has generally been described can be normalized to the same ejector rate value by either of the ways shown in FIG. 8 and FIG. 9. In FIG. 8, a common value select circuit 99 is connected to normalizer adjuster 100 for machine 1, 100*a* for machine 2, and 100*b* for machine 3. This circuit is substantially the same as master select circuit 62 shown in FIG. 1. The respective normalizers are connected to the respective programmable memories 102, 102*a* and 102*b* for the three machines.

In FIG. 9, a supervisory machine is selected. The master channel polygon pattern of machine 1 is normalized via value select circuit 99 and normalizer adjuster 100, as just described. If this machine is connected in the manner of FIG. 3, a read comparison input with a master channel orthogonal totalizer input produces an eject signal. This eject signal can then be used to normalize machines 2 and 3 to the supervisory machine 1 via normalizer adjuster 102*a* and memories 102*a* and normalizer adjuster 102*b* and memories 3102*b*.

Although only three machines are shown in FIGS. 8 and 9, any number of sorting machines can be normalized with respect to ejector rate by the same kind of connections.

Although the sorting machines have been described with respect to a single detector in each band of reflectivity, there can be multiple detectors in each band for viewing the products at different angles. If any one of the detector pairs from a common viewing angle produces a point on the orthogonal plot described herein, that product is deemed "non-acceptable" as herein discussed.

The sorting machines that have been described have been of the gravity feed variety. However, belt sorting machines can be normalized in the same fashion, since the normalizing scheme is independent of how the products are fed through the optical viewing stations.

While many embodiments of the invention have been shown with many alternatives described, it will be understood that the invention is not limited thereto. Many modifications may be made and will become apparent to those skilled in the art.

What is claimed is:

1. A sorting machine having a plurality of separate paths along which fungible products pass to be separately sorted, each path having an optical viewing station with a plurality of optical viewers for detecting the amount of light reflected off the products at a plurality of different angles in a first wavelength band and a second wavelength band, each path having an ejector downstream from its respective optical viewing station activated by an ejector signal to remove unacceptable products from the path, and a normalizing signal processing system for normalizing the ejector signals for the respective paths, each of said separate paths including a programmable memory for storing a polygon of trip levels with respect to orthogonal coordinates of reflectivity amounts in the first and second wavelength bands for each of the viewers, the area inside said polygon representing reflectivity amount coordinates for acceptable products and the area outside said polygon representing reflectivity amount coordinates for non-acceptable products, a first detector for producing a first signal representation of the reflectivity amount in the first wavelength band for each of the optical viewers from each product passing through its optical viewing station, a second detector for producing a second signal representation of the reflectivity amount in the second wavelength band for each of the optical viewers from each product passing through its optical viewing station, an orthogonal totalizer connected to said first detector and said second detector for each of the optical viewers for producing a single output for each optical viewer, an ejector comparator for receiving the output of said orthogonal totalizer for each of the optical viewers and determining whether its value is acceptable in the area inside or unacceptable in the area outside said polygon of trip levels stored in said programmable memory and producing an ejector output for each product having an unacceptable value outside of said polygon, and a normalizer adjusting means connected to a selected one of said programmable memories for a selected path for concentrically moving the trip level boundaries of the polygon therein, said normalizer adjusting means being connected to said selected path ejector comparator as the selected master so that when the ratio of the number of outputs therefrom compared to a preselected value changes, said normalizer adjusting means concentrically moving the trip level boundaries of all of said polygons in the other of said programmable memories to maintain the same output ratio of unacceptable to total products from the other paths.

2. A sorting machine in accordance with claim 1, wherein said programmable memory in each of said paths stores at least one foreign object area within the orthogonal coordinates representative of objects that are other than fungible products, and including an ejector trigger that produces an ejector output whenever there is a production of an output from said orthogonal totalizer within said foreign object area.

3. A sorting machine in accordance with claim 1, and including means for setting up each of said programmable memories respectively by inserting into said programmable memory the values of a predetermined number of representative fungible products and for circumscribing the mass of said inserted values, except for stray values, to form an electronic sorting pattern of acceptable values with respect to said orthogonal coordinates, and calculating means connected to said programmable memory for establishing a polygon of trip level values approximating said electronic sorting pattern of acceptable values, said trip levels being established at respective acceptable distances from the boundaries of said electronic sorting pattern.

4. A sorting machine in accordance with claim 1, and including flow rate regulating means connected to each of said paths upstream from the respective optical viewing stations for assuring that the same rate of fungible products passes along each of said paths.

5. A sorting machine in accordance with claim 1, and including amount measuring means connected to each of said paths for measuring the total amount of product through its optical viewing station per a predetermined time interval, said amount measuring means of said selected master one of said separate paths being connected to said normalizer adjusting means for determining the base rate per path for the sorting machine, said amount measuring means of each of the other paths being compared with the output from said amount measuring means of said selected master path for determining a multiplier factor by which the trip level boundaries of said respective polygons of said programmable memories are enlarged or reduced so that the respective path ejector comparator produces the same ratio of ejector outputs for the number of products passing through its path optical viewing station as that produced for the selected master path.

6. A sorting machine in accordance with claim 5, wherein said amount measuring means is part of one of said first and second detectors and including a threshold level detector so that every signal therefrom that exceeds a threshold level indicating the presence of a product is amount totalized.

7. A sorting machine in accordance with claim 1, wherein each of said paths includes amount measuring means for producing an output of the total amount of product through its optical viewing station per a predetermined time interval, and an amount comparator for comparing the output of said amount measuring means with a predetermined standard and producing a flow rate multiplier adjust value, said amount comparator connected to said respective path programmable memory for moving the trip level boundaries of said polygon of said programmable memory so that the respective path ejector comparator is compensated to produce the same ratio of ejector outputs for the number of products passing through its viewing station as for the other paths.

8. A sorting machine in accordance with claim 1, wherein said normalizer adjusting means includes a master amount measuring means for said selected master path for measuring the total amount of product through its optical viewing station per a predetermined time interval, a slave amount measuring means for each of said paths other than said master path for measuring the total amount of product through its respective optical viewing station per said predetermined time interval, a separate slave ratio comparator for each of said paths other than the master path for determining a flow rate ratio of the amount of product measured by said master amount measuring means and by said respective slave amount measuring means, a separate trip level adjusting means connected to said ejector comparator for said master path and said ejector comparator for a respective one of said paths other than said master path and determining the ejector rate ratio of each of said ejector outputs compared with the master path ejector output, and a separate trip level adjusting means for each of said paths other than said master path to move the trip level boundaries for the respective programmable memory polygons of each path other than the master path so that the respective ejector rate ratios are moved toward said flow rate ratio.

9. A sorting machine in accordance with claim 1, wherein each of said polygons is a quadrilateral.

10. A sorting machine having a plurality of separate paths along which fungible products pass to be separately sorted, each path having an optical viewing station in which light is reflected off the products and are detected in a first wavelength band and a second wavelength band, each path having an ejector downstream from its respective optical viewing station activated by an ejector signal to remove unacceptable products from the path, an improved signal processing system for normalizing the ejector signals for the respective paths, each of said separate paths including a programmable memory for storing a polygon of trip levels with respect to orthogonal coordinates of reflectivity amounts in the first and second wavelength bands, the area inside said polygon representing reflectivity amount coordinates for acceptable products and the area outside said polygon representing reflectivity amount coordinates for non-acceptable products, a first detector for producing a first signal representation of the reflectivity amount in the first wavelength band from each product passing through its optical viewing station, a second detector for producing a second signal representation of the reflectivity amount in the second wavelength band from each product passing through its optical viewing station, an orthogonal totalizer connected to said first detector and said second detector for producing a single output, an ejector comparator receiving the output of said orthogonal totalizer and determining whether its value is in the area inside or in the area outside said polygon of trip levels stored in said programmable memory and producing an ejector output for each product having a value outside of said polygon, and a normalizer adjusting means connected to a selected master one of programmable memories for concentrically moving the trip level boundaries of its respective polygon, said normalizer adjusting means being connected to said selected path ejector comparator as the selected master so that when the ratio of the number of outputs therefrom compared to a pre-selected value changes, said normalizer adjusting means concentrically moves the trip level boundaries of all of said polygons in the other of said programmable memories to maintain the same output ratio of unacceptable to total products from the other paths.

11. A sorting machine having a plurality of separate paths along which fungible products pass to be separately sorted, each path having an optical viewing station in which light is reflected off the products and are detected in a first wavelength band and a second wavelength band, each path having an ejector downstream from its respective optical viewing station activated by an ejector signal to remove unacceptable products from the path, and an improved signal processing system for normalizing the ejector signals for the respective paths, each of said separate paths including a programmable memory for storing a polygon of trip levels with respect to orthogonal coordinates of reflectivity amounts in the first and second wavelength bands, the area inside said polygon representing reflectivity amount coordinates for acceptable products and the area outside said polygon representing reflectivity amount coordinates for non-acceptable products, a first detector for producing a first signal representation of the reflectivity amount in the first wavelength band from each product passing through its optical viewing station, a second detector for producing a second signal representation of the reflectivity amount in the second wavelength band from each product passing through its optical viewing station, an orthogonal totalizer connected to said first detector and said second detector for producing a single output, an ejector comparator receiving the output of said orthogonal totalizer and determining whether its value is in the area inside or in the area outside said polygon of trip levels stored in said programmable memory and producing an ejector output for each product having a value outside of said polygon, an adjustable ratio evaluator for determining the ratio of the number of orthogonal totalizer values inside said polygon to the number of orthogonal totalizer values outside said polygon, and a normalizer adjusting means connected to a selected master one of said programmable memories for concentrically moving the trip level boundaries of its respective polygon, said normalizer adjusting means being connected to said selected path ratio evaluator so that when the ratio of said selected ratio evaluator changes, said normalizer adjusting means concentrically moves the trip level boundaries of all of said polygons in the other of said programmable memories to maintain the same output ratio of unacceptable to total products from the other paths.

12. A sorting machine having a plurality of separate paths along which fungible products pass to be separately sorted, each path having an optical viewing station with a plurality of optical viewers for detecting the amount of light reflected off the products at a plurality of different angles, each path having an ejector downstream from its respective optical viewing station activated by an ejector signal to remove unacceptable products from the path, and an improved normalizing signal processing system for normalizing the ejector signals for the respective paths, each of said separate paths including a programmable memory for storing a trip level of a reflectivity amount for each of the viewers, the area to a first side of said trip level representing reflectivity amounts for acceptable products and the area to the second side of said trip level representing reflectivity amounts for non-acceptable products, a detector for producing a signal representation of the reflectivity amount for each of the optical viewers from each product passing through its optical viewing station, an ejector comparator for receiving the outputs of said each of said detectors and determining whether its value is acceptable in the area to the first side of said trip level or unacceptable in the area to the second side of said trip level stored in said programmable memory and producing an ejector output for each product having an unacceptable value, and a normalizer adjusting means connected to a selected one of said programmable memories for a selected path for moving the trip level therein, said normalizer adjusting means being connected to said selected path ejector comparator as the selected master so that when the ratio of the number of outputs therefrom compared to a preselected value changes, said normalizer adjusting means moves the corresponding trip level of all of the other of said programmable memories to maintain the same output ratio of unacceptable to total products from the other paths.

13. A complex of sorting machines, each of said sorting machines having a plurality of separate paths along which fungible products pass to be separately sorted, each path having an optical viewing station with a plurality of optical viewers for detecting the amount of light reflected off the products at a plurality of different angles in a first wavelength band and a second wavelength band, each path having an ejector downstream from its respective optical viewing station activated by an ejector signal to remove unacceptable products from the path, and a normalizing signal processing system for normalizing the ejector signals for the respective paths, each of said separate paths including a programmable memory for storing a polygon of trip levels with respect to orthogonal coordinates of reflectivity amounts in the first and second wavelength bands for each of the viewers, the area inside said polygon representing reflectivity amount coordinates for acceptable products and the area outside said polygon representing reflectivity amount coordinates for non-acceptable products, a first detector for producing a first signal representation of the reflectivity amount in the first wavelength band for each of the optical viewers from each product passing through its optical viewing station, a second detector for producing a second signal representation of the reflectivity amount in the second wavelength band for each of the optical viewers from each product passing through its optical viewing station, an orthogonal totalizer connected to said first detector and said second detector for each of the optical viewers for producing a single output for each optical viewer, an ejector comparator for receiving the output of said orthogonal totalizer for each of the optical viewers and determining whether its value is acceptable in the area inside or unacceptable in the area outside said polygon of trip levels stored in said programmable memory and producing an ejector output for each product having an unacceptable value outside of said polygon, and a normalizer adjusting means connected to a selected one of said programmable memories for a selected path for concentrically moving the trip level boundaries of the polygon therein, said normalizer adjusting means being connected to said selected path ejector comparator as the selected master so that when the ratio of the number of outputs therefrom compared to a preselected value changes, said normalizer adjusting means concentrically moving the trip level boundaries of all of said polygons in the other of said programmable memories to maintain the same output ratio of unacceptable to total products from the other paths; and said complex of sorting machines including master value select means applied to the normalizer adjusting means in each of the complex of sorting machines to normalize them to the same value.

14. A complex of sorting machines, each of said sorting machines having a plurality of separate paths along which fungible products pass to be separately sorted, each path having an optical viewing station with a plurality of optical viewers for detecting the amount of light reflected off the products at a plurality of different angles in a first wavelength band and a second wavelength band, each path having an ejector downstream from its respective optical viewing station activated by an ejector signal to remove unacceptable products from the path, and a normalizing signal processing system for normalizing the ejector signals for the respective paths, each of said separate paths including a programmable memory for storing a polygon of trip levels with respect to orthogonal coordinates of reflectivity amounts in the first and second wavelength bands for each of the viewers, the area inside said polygon representing reflectivity amount coordinates for acceptable products and the area outside said polygon representing reflectivity amount coordinates for non-acceptable products, a first detector for producing a first signal representation of the reflectivity amount in the first wavelength band for each of the optical viewers from each product passing through its optical viewing station, a second detector for producing a second signal representation of the reflectivity amount in the second wavelength band for each of the optical viewers from each product passing through its optical viewing station, an orthogonal totalizer connected to said first detector and said second detector for each of the optical viewers for producing a single output for each optical viewer, an ejector comparator for receiving the output of said orthogonal totalizer for each of the optical viewers and determining whether its value is acceptable in the area inside or unacceptable in the area outside said polygon of trip levels stored in said programmable memory and producing an ejector output for each product having an unacceptable value outside of said polygon, and a normalizer adjusting means connected to a selected one of said programmable memories for a selected path for concentrically moving the trip level boundaries of the polygon therein, said normalizer adjusting means being connected to said selected path ejector comparator as the selected master so that when the ratio of the number of outputs therefrom compared to a preselected value changes, said normalizer adjusting means concentrically moving the trip level boundaries of all of said polygons in the other of said programmable memories to maintain the same output ratio of unacceptable to total products from the other paths, wherein, one of the sorting machines of said complex is designated as the supervisory machine and includes value select means having an output connected as the preselected value to the master path normalizer adjusting means of said supervisory machine, each of the master path normalizer adjusting means of the sorting machines other than the supervisory machines receiving its preselected value from the output of said supervisory machine master path ejector comparator, thereby normalizing the ejector rates of all machines to that of the supervisory machine.

* * * * *